United States Patent [19]

Kang et al.

[11] Patent Number: 4,904,317

[45] Date of Patent: Feb. 27, 1990

[54] EROSION RESISTANT AG-$SnO_2$ ELECTRICAL CONTACT MATERIAL

[75] Inventors: Shinhoo Kang, Wayland; Charles Brecher, Lexington, both of Mass.; Philip C. Wingert, Greensboro, N.C.

[73] Assignee: Technitrol, Inc., Pa.

[21] Appl. No.: 194,353

[22] Filed: May 16, 1988

[51] Int. Cl.[4] ..... C22C 32/00

[52] U.S. Cl. ..... 148/431; 200/266; 428/929

[58] Field of Search ..... 148/431; 428/929; 200/266, 267; 420/501, 506

[56] References Cited

U.S. PATENT DOCUMENTS

| | | | |
|---|---|---|---|
| 2,830,898 | 4/1958 | Gwyn, Jr. | 148/431 |
| 3,515,542 | 6/1970 | Larsen | 148/431 |
| 3,607,244 | 9/1971 | Kabayama et al. | 148/431 |
| 3,785,810 | 1/1974 | Durrwachter et al. | 148/431 |
| 3,874,941 | 4/1975 | Shibata | 148/431 |
| 3,922,180 | 11/1975 | Fuchs et al. | 148/431 |
| 3,933,485 | 1/1976 | Shibata | 148/431 |
| 3,933,486 | 1/1976 | Shibata | 148/431 |
| 4,050,930 | 9/1977 | Motoyoshi et al. | 148/431 |
| 4,056,365 | 11/1977 | Bevington et al. | 428/565 |
| 4,072,515 | 2/1978 | Motoyoshi et al. | 148/431 |
| 4,131,458 | 12/1978 | Satoh et al. | 148/431 |
| 4,141,727 | 2/1979 | Shida et al. | 75/232 |
| 4,150,982 | 4/1979 | Shibata | 148/431 |
| 4,204,863 | 5/1980 | Schreiner | 75/234 |
| 4,243,413 | 1/1981 | Shibata | 75/234 |
| 4,279,649 | 7/1981 | Fujiwara et al. | 148/431 |
| 4,294,616 | 10/1981 | Kim et al. | 75/234 |
| 4,330,330 | 5/1982 | Bohm | 148/430 |
| 4,341,556 | 7/1982 | Bohm et al. | 148/430 |
| 4,361,033 | 11/1982 | Kim et al. | 73/64.4 |
| 4,410,491 | 10/1983 | Bohm et al. | 420/501 |
| 4,450,135 | 5/1984 | Peters et al. | 419/12 |
| 4,452,652 | 6/1984 | Shibata | 148/431 |
| 4,514,238 | 4/1985 | Shibata | 148/431 |
| 4,551,301 | 11/1985 | Schreiner | 419/21 |
| 4,565,590 | 1/1986 | Grosse et al. | 148/431 |

*Primary Examiner*—Robert McDowell

*Attorney, Agent, or Firm*—Armstrong, Nikaido, Marmelstein, Kubovcik & Murray

[57] ABSTRACT

An erosion resistant electrical contact material and a method of making the material is described. The material comprises from about 10 to about 20 volume percent of $SnO_2$, from about 0.45 to about 1.2 volume percent of an oxide selected from the group consisting of $TiO_2$, $CeO_2$, $ZrO_2$, $HfO_2$, and combinations thereof and the balance being substantially silver.

6 Claims, No Drawings

EROSION RESISTANT AG-$SNO_2$ ELECTRICAL CONTACT MATERIAL

CROSS REFERENCE TO RELATED APPLICATION

A co-pending patent application , Ser. No. 194,351 now abandoned, filed concurrently herewith, entitled "METHOD FOR MAKING A DENSE EROSION RESISTANT ELECTRICAL CONTACT MATERIAL", and assigned to GTE Laboratories Incorporated and GTE Products Corporation, assignees of the present application, concerns related subject matter of this application.

FIELD OF THE INVENTION

This invention relates to an electrical contact material. More particularly, this invention relates to an erosion resistant electrical contact material.

BACKGROUND OF THE INVENTION

Present power switching contacts are composites of silver and cadmium oxide, the former for electrical conductivity, the latter to reduce the probability that the contacts will weld together. Although such materials give fully satisfactory performance, the potential of environmental restriction on fabrication has stimulated a search for alternatives. Of all potential candidates the most attractive material system is Ag-$SnO_2$. However, such materials have been found to be excessively susceptible to cracking under the thermal stress imposed by switching arcs.

One approach to deal with this problem is to introduce an additive that reduces the surface energy and enhances the wetting by molten silver, thereby reducing the rate at which surface cracks propagate into the bulk. This approach has been the basis for the so-called matrix-strengthening effect in Ag-$SnO_2$ system as well.

However, the approach of the present invention is to increase the compact strength by improving the bonding between silver and oxide particles, thereby reducing the tendency of cracks to form in the first place.

SUMMARY OF THE INVENTION

In accordance with one aspect of the present invention, a new and improved electric contact material comprises from about 10 to about 20 volume percent $SnO_2$, from about 0.4 to about 4.0 volume percent of a dopant oxide, and the balance being substantially silver.

DETAILED DESCRIPTION OF THE PREFERRED EMBODIMENTS

The addition of small amounts of $TiO_2$ has been found to produce significant improvement in the erosion resistance of Ag-$SnO_2$ contacts. The first evidence of this effect was found from static gap erosion measurements and confirmed by electromechanical switching tests. The improvement can be attributed to an enhanced bonding at the interface between silver and the oxide granules, thereby reducing the rate of formation of cracks under the influence of thermal stress. The effect appears to be associated with the high thermal stability of the $TiO_2$ additive, a property that it shares with a number of other chemically similar oxides, such as $CeO_2$, $HfO_2$, and $ZrO_2$. Furthermore, measurement of wetting angles of molten silver on test plaques of these oxides suggests that, to a certain extent, they can also improve the wetting of Ag on the contact surfaces, thus also reducing probability of propagation into the bulk of the sample. These points appear to be borne out by experiment.

Ag-$SnO_2$ contacts doped with the above mentioned oxides were prepared by the following technique. As received powders of silver and the various dopant oxides were mixed with $SnO_2$ powder that had been prefired at 1500° C. for two hours (to coarsen the particles). The amount of total oxide was kept at a level of about 10 to about 20 v/o, preferably 15 v/o, while the dopant oxides ($TiO_2$, $CeO_2$, $ZrO_2$, and $HfO_2$) were added in about 0.4 to about 4.0 v/o range, preferably in about 0.45 to about 1.2 v/o range. The mixed powders were prefired at about 450° to about 700° C. for two hours in air, then cold pressed at about 30 to about 50 ksi to form disk-shaped specimens weighing about two grams. The green compacts were degassed at about $10^{-2}$ to about $10^{-3}$ torr and at about 500° C. for about two hours, encapsulated in a glass tube with glass dividers between the compacts, and hot isostatically pressed (HiPed) at 925° C. and 12 ksi. The resulting contacts were then machined into domed cylinders, brazed into electromechanical test devices, and subjected to erosion testing. Currents of 100 amps RMS, 220 volts AC, and 0.35 power factor were switched for a total of 100,000 closures, and the relevant parameters (material loss, arc duration, and interfacial resistance) recorded through the duration of the test sequence. Selected eroded specimens were sectioned and examined by scanning electron microscopy (SEM).

Results with the $TiO_2$ additive are summarized in Table 1. The data show that the rate of material loss is substantially reduced through the presence of the additive, compared to equivalent material without the additive. The erosion resistance is also superior to that exhibited by Ag-CdO, used as a reference material. SEM micrographs showed evidence of improved interparticulate bonding, with instances of cracks fracturing individual oxide particles rather than following the Ag-oxide interface. Similar effects have been found to be produced by the chemically similar oxides $CeO_2$, $ZrO_2$, and/or $HfO_2$.

TABLE 1

Erosion characteristics of various Ag—$SnO_2$ contact material systems

| Test # | Material | OXIDE CONCENTRATION Total (v/o) | Additive (v/o) | Erosion Rate ($10^{-8}$ per ARC) Average for 100000 ARCS | Initial | Final after 100000 ARCS | Accel. of Erosion rate ($10^{-4}$ % per ARC) | Projected Useful Life* (1000 ARCS) |
|---|---|---|---|---|---|---|---|---|
| 1 | Ag—CdO | 18.6 | — | 6.68 | 3.55 | 11.49 | 11.75 | 152 |
| 2 | Ag—$SnO_2$ | 18.6 | — | 15.53 | 6.05 | 32.98 | 17.00 | 97 |
| 3 | Ag—$SnO_2$ | 18.6 | — | 8.45 | 4.08 | 15.50 | 13.35 | 133 |
| 4 | Ag—$SnO_2$ ($TiO_2$) | 18.6 | 2.4 | 5.85 | 2.54 | 11.55 | 15.16 | 151 |
| 5 | Ag—$SnO_2$ ($TiO_2$) | 12.4 | 2.4 | 7.09 | 5.25 | 9.35 | 5.77 | 169 |

*Number of arcs needed to erode 15 $mm^3$

In summary, therefore, the invention has two aspects: a new approach for improving the erosion resistance of electric contacts by increasing the interparticle bonding; and specific chemical additives that can produce the desired effect. The successful utilization of the effect can enable use of Ag-$SnO_2$ contacts in applications not previously achievable.

While there has been shown and described what is at present considered the preferred embodiment of the invention, it will be obvious to those skilled in the art that various changes and modifications may be made therein without departing from the scope of the invention as defined by the appended claims.

What is claimed is:

1. An electrical contact material consisting essentially of from about 10 to about 20 volume percent $SnO_2$; from about 0.4 to about 4.0 volume percent of a dopant oxide selection from the group consisting of $TiO_2$, $CeO_2$, $ZrO_2$, $HfO_2$, and combinations thereof; and the balance being substantially silver.

2. An electrical contact material in accordance with claim 1 wherein said dopant oxide is $TiO_2$.

3. An electrical contact material in accordance with claim 1 wherein said dopant oxide is $CeO_2$.

4. An electrical contact material in accordance with claim 1 wherein said dopant oxide is $ZrO_2$.

5. An electrical contact material in accordance with claim 1 wherein said dopant oxide is $HfO_2$.

6. An electrical contact material in accordance with claim 1 wherein said dopant oxide comprises from about 0.45 to about 1.2 volume percent of said mixture.

* * * * *